US007666064B2

(12) United States Patent
Junge et al.

(10) Patent No.: US 7,666,064 B2
(45) Date of Patent: Feb. 23, 2010

(54) METHOD FOR GRINDING SEMICONDUCTOR WAFERS

(75) Inventors: Joachim Junge, Burghausen (DE); Robert Weiss, Winhoering (DE)

(73) Assignee: Siltronic AG, Munich (DE)

( * ) Notice: Subject to any disclaimer, the term of this patent is extended or adjusted under 35 U.S.C. 154(b) by 0 days.

(21) Appl. No.: 12/140,307

(22) Filed: Jun. 17, 2008

(65) Prior Publication Data

US 2009/0011683 A1 Jan. 8, 2009

(30) Foreign Application Priority Data

Jul. 4, 2007 (DE) ..... 10 2007 030 958

(51) Int. Cl.
*B24B 49/00* (2006.01)

(52) U.S. Cl. ..... 451/7; 451/21; 451/41; 451/53; 451/450

(58) Field of Classification Search ..... 451/7, 451/8, 21, 41, 53, 285, 287, 449, 450
See application file for complete search history.

(56) References Cited

U.S. PATENT DOCUMENTS

| | | | | |
|---|---|---|---|---|
| 5,113,622 | A | 5/1992 | Nishiguchi et al. | |
| 6,066,565 | A | 5/2000 | Kuroki et al. | |
| 6,305,183 | B1 * | 10/2001 | Mukai et al. | 62/376 |
| 6,767,273 | B1 * | 7/2004 | Coverdale et al. | 451/5 |
| 2001/0025660 | A1 | 10/2001 | Ball | |
| 2005/0173377 | A1 | 8/2005 | Pietsch et al. | |
| 2006/0252356 | A1 * | 11/2006 | Webster | 451/65 |

FOREIGN PATENT DOCUMENTS

| | | | |
|---|---|---|---|
| DE | 10 142 400 | A1 | 3/2003 |
| DE | 10 2004 005702 | A1 | 9/2005 |
| EP | 0 868 974 | A2 | 10/1998 |
| EP | 1 049 145 | A1 | 11/2000 |
| JP | 58 143948 | A | 8/1983 |
| JP | 2 250 771 | A | 10/1990 |

OTHER PUBLICATIONS

Patent Abstract of Japan corresponding to JP 58 143948 A.
Patent Abstract of Japan corresponding to JP 2250771 A.

* cited by examiner

*Primary Examiner*—Eileen P. Morgan
(74) *Attorney, Agent, or Firm*—Brooks Kushman P.C.

(57) ABSTRACT

Semiconductor wafers are processed so as to remove material on one or both sides by means of at least one grinding tool, with coolant supplied into a contact region between the semiconductor wafer and the at least one grinding tool, characterized in that the coolant flow rate is set as a function of a grinding tooth height of the at least one grinding tool and this coolant flow rate is reduced as the grinding tooth height decreases.

15 Claims, No Drawings

METHOD FOR GRINDING SEMICONDUCTOR WAFERS

BACKGROUND OF THE INVENTION

1. Field of the Invention

The present invention relates to a method for grinding semiconductor wafers.

2. Background Art

Semiconductor wafers are produced according to the prior art by a plurality of process groups:

a) producing a monocrystalline semiconductor ingots (crystal growth)

b) slicing the ingot into individual wafers ("wafering", "sawing")

c) mechanical processing d) chemical processing e) chemical-mechanical processing f) optionally coating.

In addition to the foregoing groups, a multiplicity of further steps, such as cleaning, sorting, measuring and packaging steps, may also be carried out.

The group of mechanical processing steps comprises rounding the wafer edge and planarizing the wafer surface by means of mechanically abrasive steps which remove material. Edge rounding is carried out by grinding or polishing, for example with round or band-shaped tools.

Planarizing of the wafer surface is carried out "in batch", i.e. for a plurality of wafers simultaneously, by so-called "lapping" with free abrasive using a lapping suspension ("slurry") or as a single-wafer process by grinding with bound abrasive.

In the case of single-sided grinding, one side of the semiconductor wafer is fixed by means of a vacuum in a wafer carrier ("chuck"), and the other side is processed by a grinding disc coated with grinding abrasive. If both sides of the wafer are intended to be ground, the processing of the two sides of the semiconductor wafer is generally carried out sequentially.

Batch double-sided grinding methods are also employed, with lapping kinematics in which there is bound abrasive or abrasive applied onto coatings (cloth) onto large working discs facing one another, between which the semiconductor wafers are ground on both sides as in the case of lapping while being partially free to move in guide cages.

In order to achieve a particularly good geometry of the processed wafers, a simultaneous double-sided grinding method ("double disc grinding", DDG) is often used.

EP 1 049 145 A1 discloses a processing sequence which involves a DDG pregrinding step ("roughing"), followed by one or more (sequential) single-sided fine grinding steps ("flattening").

Conversely, U.S. Pat. No. 6,066,565 describes the use of the DDG method in a two-stage process with double-sided pregrinding and a double-sided fine grinding. This requires two machines and clamping the workpiece a plurality of times.

DE 101 42 400 A1 discloses a method which is carried out with a simultaneous double-sided grinding machine and is characterized in that it comprises only a single processing operation with the workpiece being clamped only once. This means that the generally required pre-processing and fine processing ("roughing" and "flattening") take place in a single integrated processing step. Also described is a simultaneous double-sided grinding method, using a workpiece retainer which holds and moves the semiconductor wafer virtually without constrained guiding ("free-floating process", FFP).

In the case of simultaneous double-sided grinding, which is also described for example in EP 868 974 A2, the semiconductor wafer is processed simultaneously on both sides while floating freely between two grinding discs mounted on opposite collinear spindles, and is guided substantially free from constraining forces axially between a water cushion (hydrostatic principle) or air cushion (aerostatic principle) acting on the front and back sides, and is radially prevented from floating thereon loosely by a thin circumferential guide ring or by individual radial spokes. The semiconductor wafer rotates about its symmetry axis during the grinding. This rotation is driven by friction tools engaging on the front and back sides, via a "notch finger" which engages in an orienting reference "notch", or by friction belts which partially enclosed the semiconductor wafer circumferentially.

DE 10 2004 005 702 A1 discloses a method for producing a semiconductor wafer, comprising double-sided grinding of the semiconductor wafer in which the semiconductor wafer is ground initially coarsely and subsequently finely on both sides by a grinding tool, during which the semiconductor wafer remains clamped in the grinding machine between coarse and fine grinding, and the grinding tool engages with an essentially constant load when changing from course grinding to fine grinding. DE 10 2004 005 702 A1 furthermore describes a device for the double-sided grinding of flat workpieces, comprising two double spindles each with an inner sub-spindle and an outer sub-spindle, an instrument for loading and unloading the workpiece, and a workpiece retainer which is arranged between the double spindles and by which the workpiece is held free-floating during grinding. The sub-spindles are arranged coaxially and carry grinding tools for grinding opposite sides of the workpiece, at least one sub-spindle of each double spindle being axially displaceable independently of the other sub-spindle of the double spindle.

During the grinding processes, whether single-sided or double-sided grinding, it is necessary to cool the grinding tool and/or the processed semiconductor wafer. Water or deionized water is conventionally used as a coolant. Commercial grinding machines, for example the models DFG8540 and DFG8560 ("Grinder 800 Series") from Disco Corp., which are suitable for grinding wafers with diameters of 100-200 mm and 200-300 mm respectively, are equipped on the working side with a vacuum unit which ensures a constant coolant flow rate of 1 or 3 l/min (=litres per minute) during the grinding, depending on the coolant temperature (constantly 1 l/min for a temperature of less than 22° C., constantly 3 l/min for a temperature of more than 22° C.).

Double-sided grinding machines are available for example from Koyo Machine Industries Co., Ltd. The model DXSG320 is suitable for the DDG grinding of 300 mm wafers. Both vertical and horizontal spindles are employed in combination with special diamond grinding tools. These grinding tools are designed so that they cut only with the edge and combine a rapid forward feed rate with little heat production. The main difference is the wafer holding. The wafer to be processed is fixed by hydrostatic pressure pads on both sides in a transport ring. The wafer is driven merely by a small nose which engages in the notch or in the flat. Stress-free holding of the wafer can be ensured in this way.

JP58143948 describes a method for cooling in single-sided grinding machines and the way in which the coolant is applied onto the wafer surface to be processed. JP2250771 teaches to determine the coolant flow rate and, depending on a measured grinding temperature, to increase it rapidly in order to both keep the grinding temperature within a predetermined temperature range and to keep the amount of coolant used at the minimum required level.

In double-sided grinding machines, the process coolant conventionally emerges from the centre of the grinding tool and is transported to the grinding teeth by means of the centrifugal force. The coolant throughput can be regulated by keeping the coolant flow rate at a setpoint value. This regulating may be carried out electronically by means of a suitable measuring device and actuators or by mechanical means (pressure reducer).

US 2001/025660 AA proposes to monitor machine working/engagement times and machine idle/setup times ("active" and "idle" modes) of the grinding machine automatically and to regulate the coolant flow rate accordingly. At the start of the setup time the coolant flow is reduced or entirely stopped, and it is subsequently increased periodically during the setup time, i.e. the introduction of a new workpiece. This achieves more economical use of coolant compared with the solutions likewise known in the prior art, namely to keep the coolant flow rate constant even during the machine idle time. A certain coolant flow rate at least towards the end of the setup time seems to be advantageous, since the grinding machines contain sensors which are extremely sensitive to temperature differences.

U.S. Pat. No. 5,113,622 AA proposes temperature detectors on the coolant in- and outflows. The difference between the temperatures at the inflow and the outflow is thereby determined. This temperature difference is intended to indicate the amount of heat generated during the grinding, by taking into account the coolant flow rate and the dissipation of heat. In order to keep the temperature of the GaAs wafer to be processed below a particular target temperature, and to avoid fracture or warp due to residual thermal stresses, corresponding regulation of the coolant flow rate is proposed as a function of the continuously determined amounts of heat.

Known prior art methods therefore involve either keeping the temperature of the workpiece constant or below a target value and increasing the coolant flow rate accordingly, or setting a constant coolant flow rate with one or two target values. Problems, which the prior art was not able to resolve at the application date, consist of workpieces ground with one and the same grinding tool having different surface damages, which implies non-constant grinding conditions, and also the lifetime of grinding tools. In the latter context, one skilled in the art recognizes that grinding tool service life is generally unsatisfactory even when a constant coolant flow rate and (therefore) supposedly sufficient cooling of the workpiece and the grinding tool are meant to be ensured.

SUMMARY OF THE INVENTION

It was an object of the present invention to achieve more constant grinding conditions and an improved type of cooling in grinding machines. These and other objects are achieved by a method for grinding semiconductor wafers, the semiconductor wafers being processed so as to remove material on one or both sides by means of at least one grinding tool, with a supply of a coolant delivered into a contact region between a semiconductor wafer and the at least one grinding tool, wherein the coolant flow rate is set as a function of a grinding tooth height of the grinding tool, and this coolant flow rate is reduced as the grinding tooth height decreases.

DETAILED DESCRIPTION OF THE PREFERRED EMBODIMENT(S)

Both single-sided and a double-sided grinding machines according to the prior art are suitable for the method according to the invention. The invention preferably relates to a method for the single-sided grinding of semiconductor wafers. Methods for the simultaneous double-sided grinding of semiconductor wafers (DDG) are most preferred.

Preferably, when using an unworn grinding tool fresh from the factory, a current grinding tooth height of this grinding tool is respectively determined during the grinding processes and the coolant flow rate is reduced as a function of the grinding tooth height determined in this way, although the coolant flow rate should not fall below a particular minimum value even with a low grinding tooth height. In contrast to the prior art, the coolant flow rate is thus not constant or even increased, rather it is reduced.

The Inventors have discovered that only in this way is it possible to achieve constant cooling of the contact region between a workpiece and a grinding tool. The coolant then stops in front of the grinding teeth, flows around them and is turbulated as a function of the height of the grinding teeth in the contact region between the workpiece and the grinding tool. The amount of coolant which reaches this contact region is crucial for the grinding outcome ("sub-surface damage") and the service life of the grinding tool.

Ceramically bound diamond grinding teeth are subject to wear, so that the height of the grinding teeth decreases with an increasing length of use. The Inventors have discovered that in the prior art, constant cooling of the contact region between a workpiece and a grinding tool is not in fact possible throughout the period of use, when provision is simply made to keep the coolant flow rate constant. Rather, the Inventors have discovered that it is advantageous to set a higher coolant throughput for tools fresh from the factory than for worn tools.

When the grinding tooth height of the workpiece reaches a minimum value, the throughput should be selected to be so low as to prevent an aquaplaning effect, which would interrupt the grinding process. This applies most to double-sided grinding machines, whereas the aquaplaning effect is less critical for single-sided machines.

In order to avoid the aquaplaning effect with a continuously constant coolant flow rate in the prior art, grinding tools reaching a critical minimum grinding tooth height have been replaced.

Software of the electronic cooling-water flow regulator ensures that a current setpoint value of the coolant flow rate for the one grinding tool, or for both grinding tools separately, is determined via a parameterizable profile, comprising a plurality of sample points and dependent on the grinding tooth height, of the coolant flow rate (cf. Example and Table 1) after measuring a current grinding tooth height.

The throughput is regulated, preferably by means of an actuator or a pressure reducer, to this setpoint value which changes with the grinding tooth height. The corresponding actuator and pressure reducer devices are already known in the prior art for ensuring a constant coolant flow rate by regulation.

The current grinding tooth height of the grinding tool or tools, is preferably ascertained after each workpiece has been processed.

The particular advantages of the method of the invention are that constant surface damage is achieved throughout the grinding tool service life owing to constant cooling of the contact region between the workpiece and the grinding tool.

The method furthermore prevents aquaplaning from occurring with a low grinding tooth height, or replacing the grinding tool prematurely when a particular grinding tooth height is reached. In the prior art, the device for measuring the grinding tooth height was provided for the purpose of monitoring the grinding tooth height in order to carry out the necessary tool replacement immediately when the minimum grinding tooth height is reached.

Furthermore, a better cooling effect with a large grinding tooth height allows a longer grinding tool service life overall.

EXAMPLE

The following example relates to a double-sided grinding machine of the DXSG320 type from Koyo Machine Industries.

Here, the two vertically arranged grinding tools are cooled separately from one another, i.e. different coolant throughputs are selected for the left and right grinding tools in the event that the grinding tooth height of the left grinding tool is less than that of the right grinding tool.

The water flow rate sets a 100% reference value for the left and right grinding tools. In this example, it is 1.5 litres/minute for a cooling-water temperature of 21° C., which represents a conventional value according to the prior art. In the prior art, attempts are usually made to keep this water flow rate constant. The prior art has already proposed actuators or pressure reducers on the grinding machines for this purpose.

For each grinding tool, a plurality of sample points of the water flow rate are set as % of the water flow rate reference value (=100%) as a function of a current grinding tooth height, i.e. for example a water flow rate which is 60% of the reference value (=0.9 $lmin^{-1}$) for a grinding tooth height of 0.5 mm.

The grinding tooth height, which is ascertained separately by the machine for each grinding tool after each grinding step, is specified in mm, cf. Table 1. The grinding machine in question is already equipped on the working side with devices for measuring the grinding tooth heights of the grinding tools.

TABLE 1

| | Water flow rate 1.5 1 $min^{-1}$ = 100% (left and right grinding tools) | | | | | |
|---|---|---|---|---|---|---|
| Grinding tooth height (mm) | 0.0 | 0.3 | 0.5 | 1.0 | 2.0 | 6.0 |
| Water flow rate (%) | 40 | 40 | 60 | 100 | 108 | 140 |

By means of machine software, curves are interpolated between the parameterized sample points (five sample points in this example) so that an exact setpoint value for the cooling-water flow rate can be assigned to each ascertained grinding tooth height. This setpoint value for the cooling-water flow rate is given to the in-machine regulator as a target quantity. During the grinding process, the machine then separately regulates the two grinding tools to the respective current setpoint value. The regulating per se is carried out substantially automatically by means of actuators and pressure reducers.

The grinding tools used initially have a grinding tooth height of 6.00 mm in the unused state. The water flow rate at the start is selected to be 140% of the standard value (100%) of 1.5 litres/minute. The minimum coolant flow rate to prevent aquaplaning effects is 40% of the standard value.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A method for the grinding of semiconductor wafers to remove material from at least one side thereof, comprising:

grinding a slide of a semiconductor wafer with a grinding tool having grinding teeth with a grinding tooth height;

supplying a coolant into a contact region between the side of the semiconductor wafer and the grinding tool;

establishing a first coolant flow rate as a function of tooth height of the grinding teeth of the grinding tool;

measuring the tooth height of the grinding teeth reduced in height by grinding to provide a measured tooth height; and reducing the coolant flow rate to a subsequent coolant flow rate as the measured tooth height decreases.

2. The method of claim 1, wherein a single-sided grinding machine is used and the semiconductor wafer is ground on one side by means of a grinding tool.

3. The method of claim 1, wherein a double-sided grinding machine is used and the semiconductor wafer is ground simultaneously on both sides by means of two grinding tools.

4. The method of claim 3, wherein the coolant flow rate does not fall below a preset minimum value.

5. The method of claim 4, wherein the preset minimum value is a coolant flow rate which prevents aquaplaning.

6. The method of claim 3, wherein a grinding tool with ceramically bound diamond grinding teeth is used as the grinding tool.

7. The method of claims 3, wherein a current grinding tooth height is measured for both grinding tools after each individual wafer has been ground, setpoint values of the coolant flow are determined for those grinding tooth heights and a setpoint value of coolant flow is adjusted separately for each of the two grinding tools.

8. The method of claims 1, wherein a coolant flow rate is initially selected as said first coolant flow rate when using a fresh grinding tool, a current grinding tooth height of the grinding tool is measured during grinding processes, and the coolant flow rate is reduced as a function of the measured tooth height.

9. The method of claim 8, wherein a grinding tool with ceramically bound diamond grinding teeth is used as the grinding tool.

10. The method of claim 8, wherein the current grinding tooth height is measured after a grinding operation and before a subsequent grinding operation.

11. The method of claim 8, wherein the coolant flow rate does not fall below a preset minimum value.

12. The method of claim 11, wherein the preset minimum value is a coolant flow rate which prevents aquaplaning.

13. The method of claim 1, wherein a grinding tool with ceramically bound diamond grinding teeth is used as the grinding tool.

14. The method of claim 3, wherein a setpoint value of the coolant flow rate is determined electronically as a function of the grinding tooth height by means of software, and is adjusted by means of an actuator or pressure reducer.

15. The method of claim 14, wherein the setpoint value of the coolant flow is determined by means of the software from a parameterizable profile comprising a plurality of sample points and dependent on the tooth height, the sample points representing a coolant flow rate for a previously determined grinding tooth height.

* * * * *